United States Patent [19]

Figg

[11] 4,393,774

[45] Jul. 19, 1983

[54] APPARATUS FOR PRINTING AND DISPENSING LABELS

[75] Inventor: Anthony V. J. Figg, Kirby Cross, England

[73] Assignee: Norprint International, Boston, England

[21] Appl. No.: 306,853

[22] Filed: Sep. 29, 1981

Related U.S. Application Data

[63] Continuation-in-part of Ser. No. 114,686, May 23, 1979, abandoned.

[30] Foreign Application Priority Data

May 23, 1978 [GB] United Kingdom ..... 21428/78

[51] Int. Cl.[3] ..... B41K 5/02; B41K 1/08

[52] U.S. Cl. ..... 101/288; 101/291; 101/348; 101/324

[58] Field of Search ..... 101/288, 291, 348, 334, 101/44, 287, 292, 359, 360, 321

[56] References Cited

U.S. PATENT DOCUMENTS

| | | | |
|---|---|---|---|
| 533,621 | 2/1895 | Thompson | 101/334 |
| 2,936,702 | 5/1960 | Columbus et al. | 101/44 |
| 3,094,922 | 6/1963 | Crane | 101/44 |
| 3,376,811 | 4/1968 | Grintz | 101/288 |
| 3,785,288 | 1/1974 | Hunter | 101/348 |
| 4,044,677 | 8/1977 | Hamisch, Jr. | 101/348 |
| 4,094,244 | 6/1978 | Edwards et al. | 101/288 |
| 4,149,462 | 4/1979 | Sato | 101/291 |
| 4,273,046 | 6/1981 | Sato | 101/348 |

FOREIGN PATENT DOCUMENTS

| | | | |
|---|---|---|---|
| 1350395 | 12/1963 | France | 101/288 |

*Primary Examiner*—William Pieprz

*Attorney, Agent, or Firm*—Leydig, Voit, Osann, Mayer & Holt, Ltd.

[57] ABSTRACT

A label applicator for self-adhesive labels is disclosed.

The applicator includes cam tracks which control the orientation of two pivotal print-heads during motion from a rest position to a printing position. The print-heads are mounted on levers pivoted in the casing so that motion of the print-heads takes place about two pivot centers. A rotary inking roller is positioned along the path of the operative facets of each print-head and inking takes place during movement of the corresponding print-head to ensure contact during one part of the cycle and avoids such contact during the return. The roller acts as a part of the cam track. The inking action is such that the roller is rotated by the operative facets. At the instant printing takes place, a part of the cam track serves to prevent later motion of those print facets.

The invention can be applied to label applicators (or dispensers) wherever there is a need for high quality printing on labels.

5 Claims, 5 Drawing Figures

APPARATUS FOR PRINTING AND DISPENSING LABELS

This is an application for a Continuation-In-Part Patent based on Application Ser. No. 114,686 filed 23 May 1979 (now abandoned) under the provisions of the Patent Co-operation Treaty.

This invention relates to apparatus for printing and dispensing labels, for example hand-held apparatus for use with pricing labels.

Numerous apparatus are available for printing and dispensing labels and such apparatus incorporates one or m print heads which serve, prior to the dispensing of any given label, to apply indicia to that label. The indicia usually takes the form of a price and a stock code and experience has shown that it is very important that the indicia should be so printed on the label that legibility is good even under poor lighting conditions.

The simplest form of printing involves a stamp impression but it is also very well-known in general to use rotary printing for high speed production and controlled printing quality.

In hand-held, manually-operable, apparatus, the problem of providing satisfactory indicia on labels has involved some complexity and cost which is clearly undesirable. In one such proposal a print-head is made to pivot while a label being printed is being moved forwardly simultaneously and although this gives good results in practice, the apparatus is rather complex, the more so when two print-heads are incorporated in order to provide a two row printing facility. Furthermore, it is frequently desirable that the ink used for one row of printing should differ from that used in the other.

It follows that it is desirable that the print-heads should be operated by a simple mechanism but that nevertheless the quality of the printing should be consistently good and this necessitates that the operative print facets of the print-head or heads shall be adequately inked before each printing takes place.

According to the present invention, there is provided, in apparatus for printing and dispensing labels, a print-head assembly having operative print facets, pivotal lever means mounting the said assembly, means pivotally mounting the print-head assembly on the pivotal lever means, means for actuating the lever means to bring the assembly to a printing station; and cam means, including a rotary inking roller assembly, operative to control pivotal and linear motion of the print head assembly over at least a part of the operating cycle of the apparatus while the pivotal lever means carry the print head assembly over an arcuate path centered on the pivot point of the lever means.

Hand-held label printing and dispensing apparatus embodying the invention will now be described, by way of example only, with reference to the accompanying diagrammatic drawings, in which.

Figure 1A:
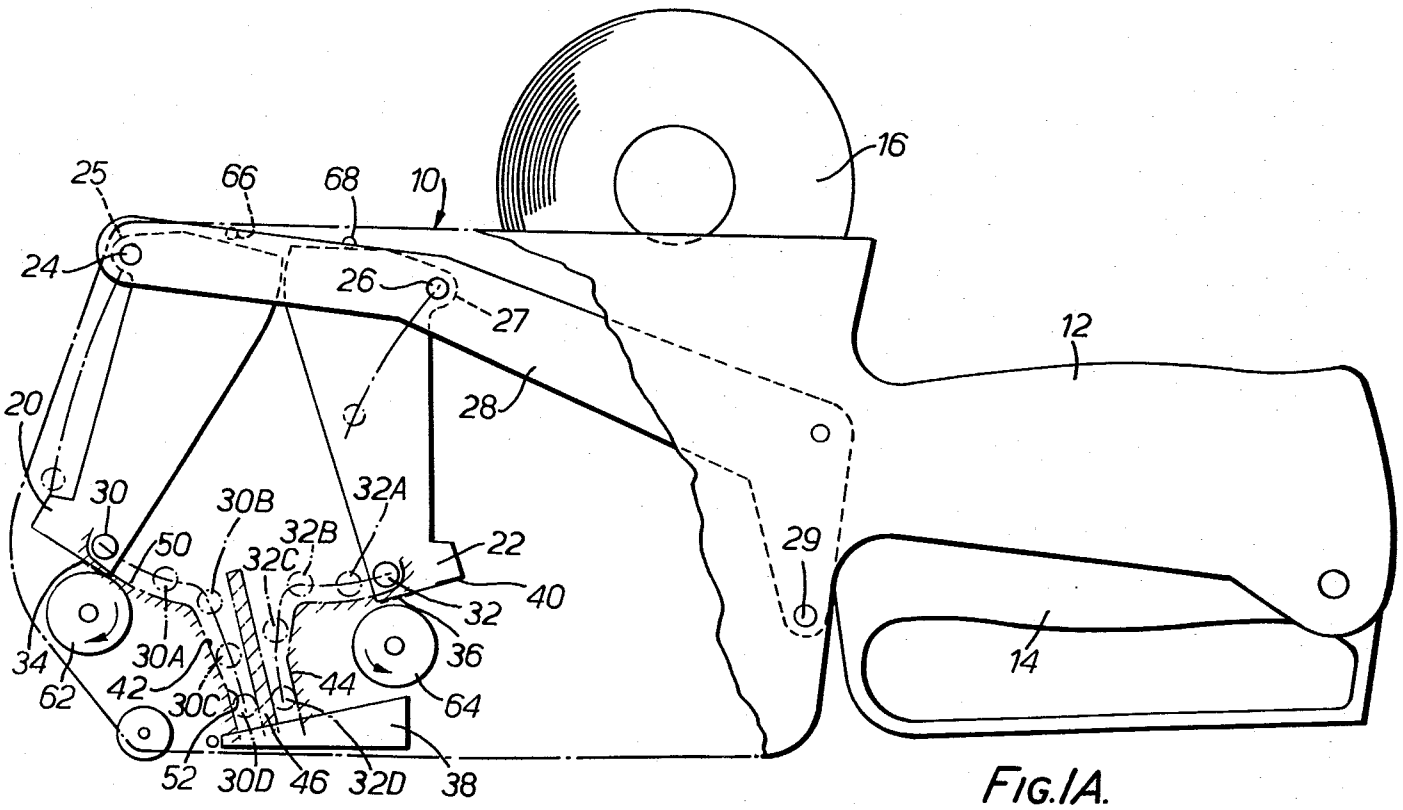
FIGS. 1A and 1B show the outline of an embodiment of apparatus in accordance with the invention with two print-head assemblies at a rest and a printing configuration.
Figure 1B:
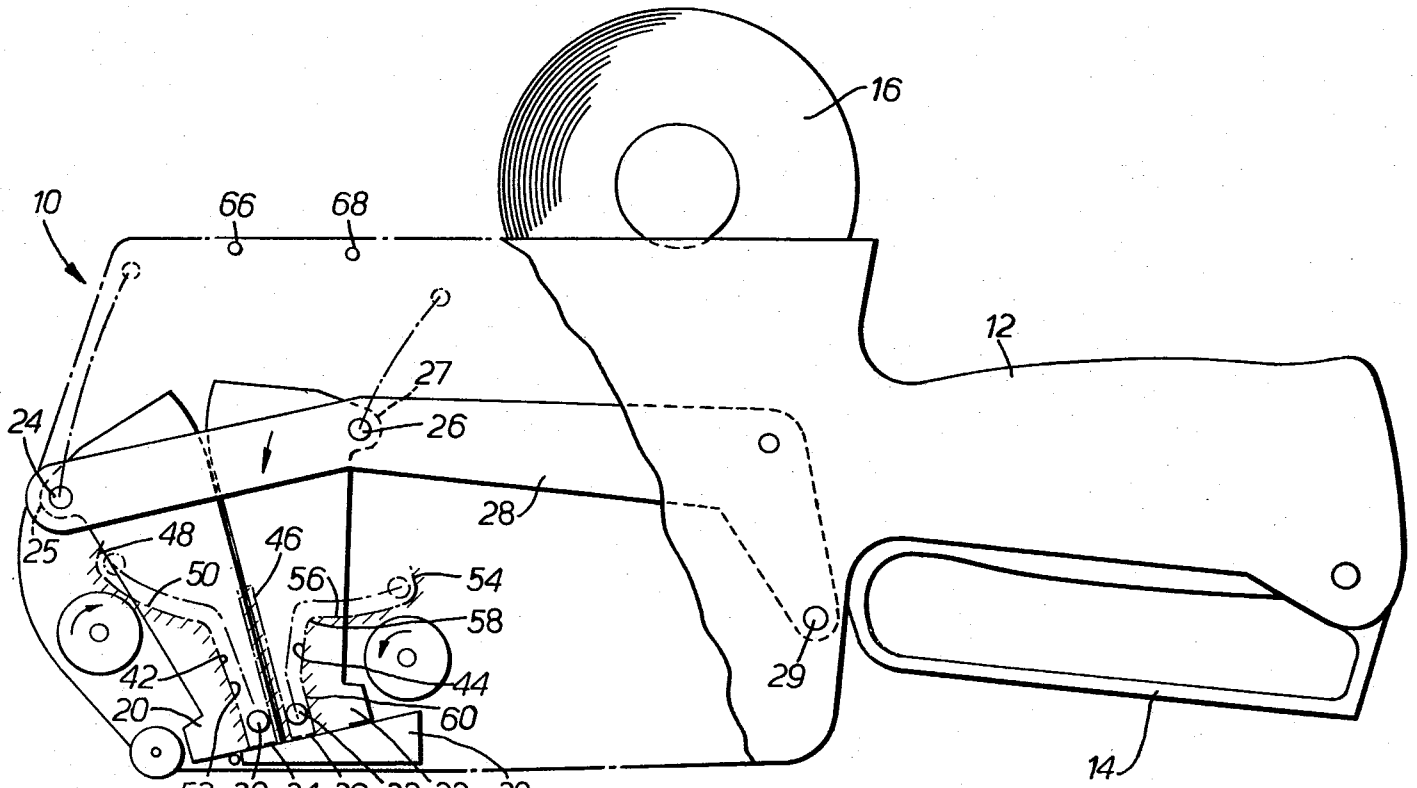

Referring now to FIGS. 1A and 1B, the hand-held label printing and dispensing apparatus as a whole comprises a body 10 rigid with a handle 12 and at the end of the handle remote from the main part of the body a trigger member 14 is pivotally mounted which serves to actuate in any given operational cycle label feed and dispensing and also printing.

The label storage and dispensing means includes a reel 16 of label web which incorporates both labels with a self-adhesive surface and a backing strip coated with silicone, and a wind-up reel 18 (FIGS. 3 and 4) for the spent backing strip after the labels have been dispensed. The wind-up reel is not illustrated in FIG. 1.

The print-head assembly comprises two separate but co-operating print-heads 20,22, both of which are pivotally mounted at pivots 24 and 26 on a pair of pivotal arms 28 (only one shown in FIG. 1). The arms are shown in greater detail in FIG. 4 together with actuating means therefor and provide a pivot axis 29 external and additional to the pivots 24 and 26 of the heads themselves. The pivots 24 and 26 provide internal pivot axes within the bounds of the respective head, but off-set laterally with respect to a plane extending along the row of operative print facets and normal to the plane containing the operative print facets. As shown the pivots are defined by lugs 25,27 of the respective print-head end plates.

Figure 2:
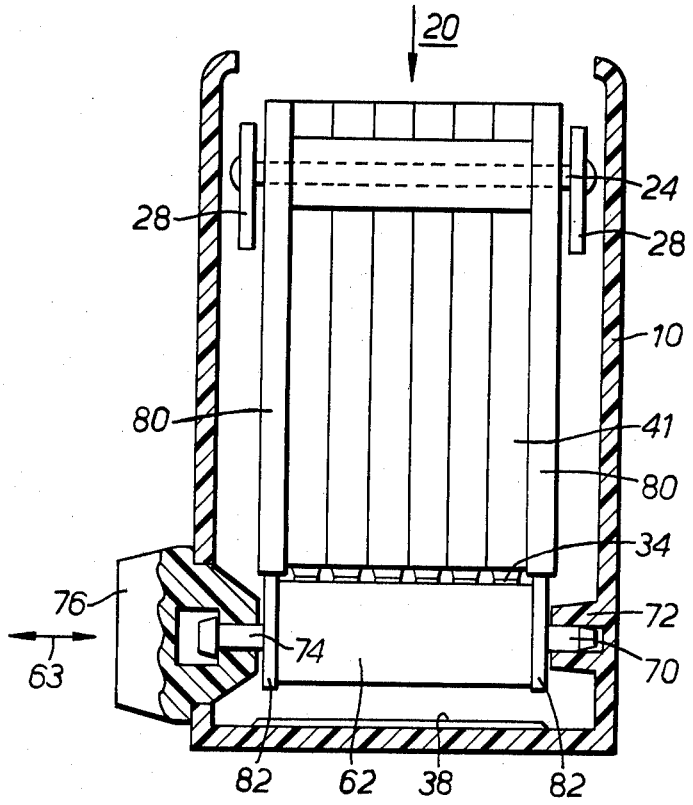
FIG. 2 is a section of one print-head assembly of the apparatus of FIGS. 1A and 1B including an inking roller.

Each print-head assembly carries a spigot 30,32 at its end adjacent to the operative print facets 34,36 thereof and pivoting actuation of the arms 28 supporting the pring-heads 20,22 controls, with the aid of the respective spigots 30,32, the movement and orientation of the heads both while inking is taking place and during their travel towards a printing platen 38 on which a label to be printed is present. One or both of the heads may also incorporate a cliche 40 which is not adjustable as are the operative print facets 34,36 which are mounted on print bands 41 (FIG. 2).

During movement of the print-heads under the action of the arms 28, the spigots 30,32 co-operate with respective cam tracks 42,44 and an intermediate track 46 lying between them which serves to prevent over-travel during the movement towards the printing platen 38 that is, towards the bottom of FIGS. 1A and 1B, as shown. The cam track 42 includes a stop portion 48 corresponding to the rest position of the print-head 20, a concave inclined portion 50, and a rectilinear portion 52 extending normal to the working face of the platen 38. The cam track 44 has a stop portion 54 corresponding to the rest position of the head 22, a concave portion 56 extending generally at right angles to the rectilinear intermediate track 46, an inclined portion 58 and a rectilinear portion 60 extending normal to the working face of the platen 38. Inking rollers 62,64 co-operate with respective print-heads 20 and 22 and effectively act as control cams as they co-operate with the operative print facets 34,36.

The arms 28 are actuated by the trigger member 14 through means, not shown in FIGS. 1A and 1B, and not forming part of the present invention. One possible mechanism is illustrated in outline in FIG. 4.

Operation of the trigger member 14 will cause the twin arms 28 to pivot from the position shown in FIG. 1A progressively to the position shown in FIG. 1B. During the first part of the operational cycle inking will take place and provided that an inking roller 62,64 is present, the spigots 30,32 do not contact the track portions 50,56 and the motions of the print heads are therefore controlled by interaction with the inking rollers 62,64 themselves. Excessive pressure by the heads on the rollers is prevented by an arrangement illustrated in and described hereinafter with reference to FIG. 2. The spigots 30,32 co-operate with the track portions 50,56 respectively in the absence of inking rollers in order to prevent damage to the mechanism. Spring means (not shown) lightly bias the heads to the open configuration of FIG. 1A. Continued movement of the support arms 28 results in the heads 20,22 disengaging from the inking rollers which have been rotated by contact with the operative print facets and the respective spigots 30,32 then move down the portions 52 and 58,60 of the cam tracks and any tendency to over-travel and thus interference between the two print-heads is prevented by the intermediate track 46 lying between the cam tracks 42 and 44. The rotary movement of the inking rollers 62,64 ensures that during each successive operation of the apparatus a different part of the ink pad periphery will be contacted, so that re-inking of the surface from the interior of the inking roller can take place ready for the next contact with the operative print facets. Locii of the spigots 30,32 are indicated in chain lines 30A,32A,30B,32B . . . and so on in FIG. 1A.

At the printing position of the two heads as shown in FIG. 1B, the spigots 30,32 are closely confined by the cam tracks 42,44 and the intermediate track so that lateral movement relative to the label on the platen 38 is positively prevented.

The return half of the operational cycle is substantially the same as the first half but the operative facets do not contact their respective ink rollers 62,64 on the return half of the cycle. This is ensured because the upwards (as shown) movement of the arms 28 does not press the operative print facets towards the inking rollers 62,64 and reset stops 66,68 provided adjacent the upper edge of each print head in its rest position are not contacted until movement of the arms 28 has been substantially completed. In other words, while the arms 28 push the operative print facets up towards the ink rollers during the first part of the operational cycle, upwards movement is effected without any such constraint so no contact occurs. Thus undesired ink transfer during the operational cycle is prevented and in the rest position the operative print facets do not contact the inking rollers 62,64.

FIG. 2 shows an end view of one print-head 20 or 22 and the corresponding inking roller 62 or 64 and the pair of pivotal arms 28 which support both print-heads. For the purpose of renewal of the inking rollers 62,64, they may be readily removable by mounting a spindle 70 of the roller in a bearing 72 integral with one wall of the casing 10 and a second spindle 74 in a knob 76 which is a snap-fit in another wall of the casing 10. As will also be apparent from FIG. 2, end plates 80 of the print-head engage during the first part of the operational cycle against corresponding flanges 82 at each end of the inking roller 62 or 64 and this engagement ensures that during the inking operation the operative print facets 34 do not dig too deeply into the spongy rubber material forming the outer face of the inking roller 62 or 64. The inking roller is readily removable and replaceable by axial movement, indicated by double-headed arrow 63. Preferably the rollers 62,64 are mounted for free, floating, movement on the spindle 70 as described in copending application Ser. No. 241,676 filed 9 Mar. 1981.

Figure 3:
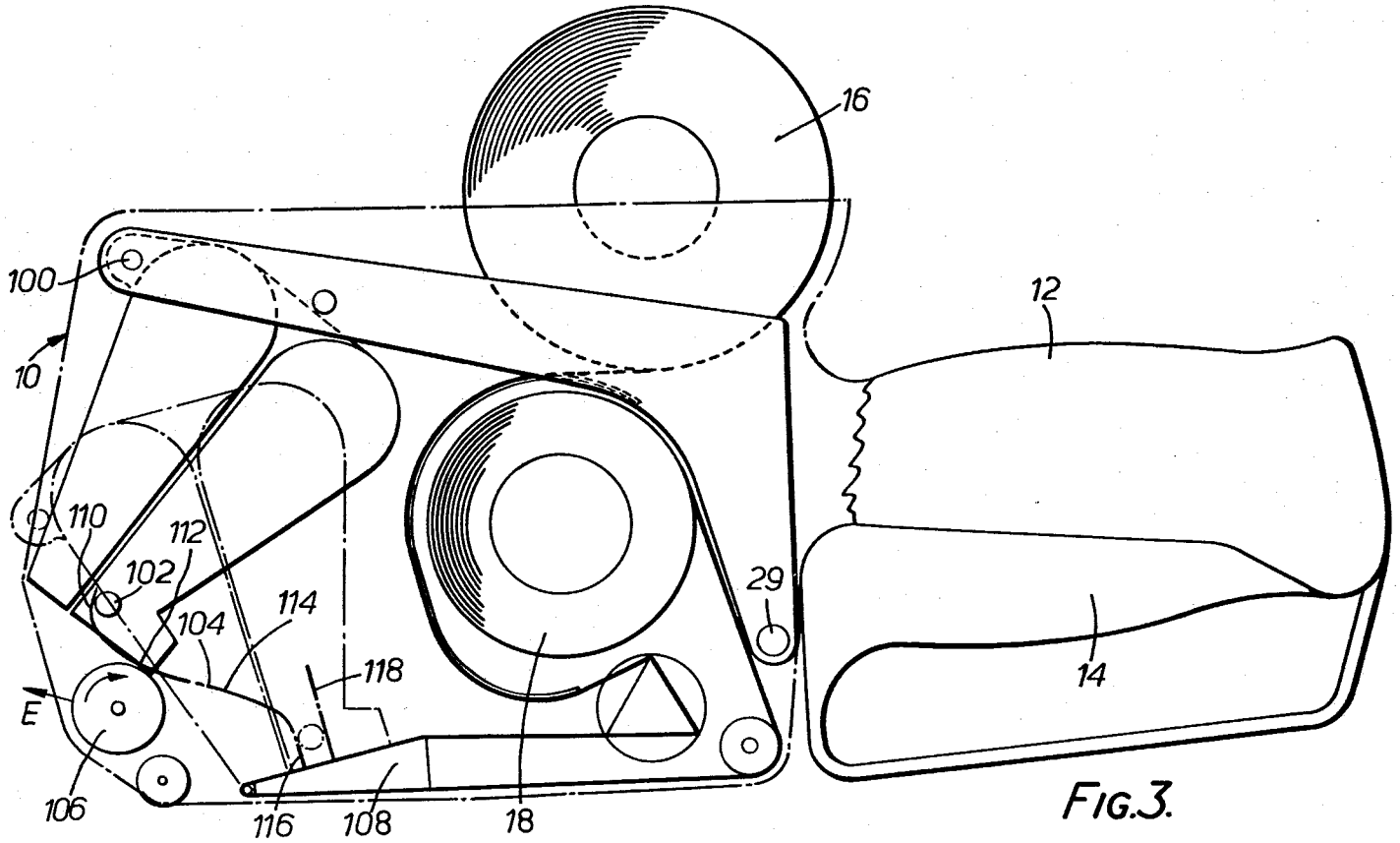
FIG. 3 is a side elevation of a modification in which the print-head assembly has provision for two lines of print in a single head.

Turning now to the modification illustrated in FIG. 3, the apparatus as a whole is generally similar to that of the first embodiment illustrated in FIGS. 1 and 2 but the print-heads are coupled and mounted about a single pivot 100, a single spigot 102 co-operates with a single cam track 104 to control movement of the print-head both in relation to the single inking roller 106 and in relation to the printing platen 108. As in the first embodiment, the inking roller itself acts as a cam or guide for the print-heads unless the inking roller is absent. The cam track 104 includes an end stop 110, a portion 112 corresponding to the inking part of the operational cycle, a portion 114 inclined in relation to the printing platen surface and a portion 116 normal to the platen surface. A second track 118 serves the same purpose as the intermediate track 46 of the first embodiment, namely to ensure freedom from lateral movement of the print-head at the instant of printing (chain lines). Spring means (not shown) bias the heads to the full line position. In this embodiment, the inking roller can be removed in the direction of the arrow E or alternatively as indicated in the embodiment of FIGS. 1 and 2. The roller removal arrangement of FIG. 3 can also be applied to the embodiments of FIGS. 1 and 2 and preferably the roller is mounted for free floating motion on its spindle.

The manner of operation of the embodiment of FIG. 3 is generally similar to that of FIGS. 1 and 2 except that only one head assembly is moved. Two line printing is again possible but may not provide as high quality as the first embodiment since any slight misalignment of the single pivotal assembly cannot be as readily accommodated.

Figure 4:
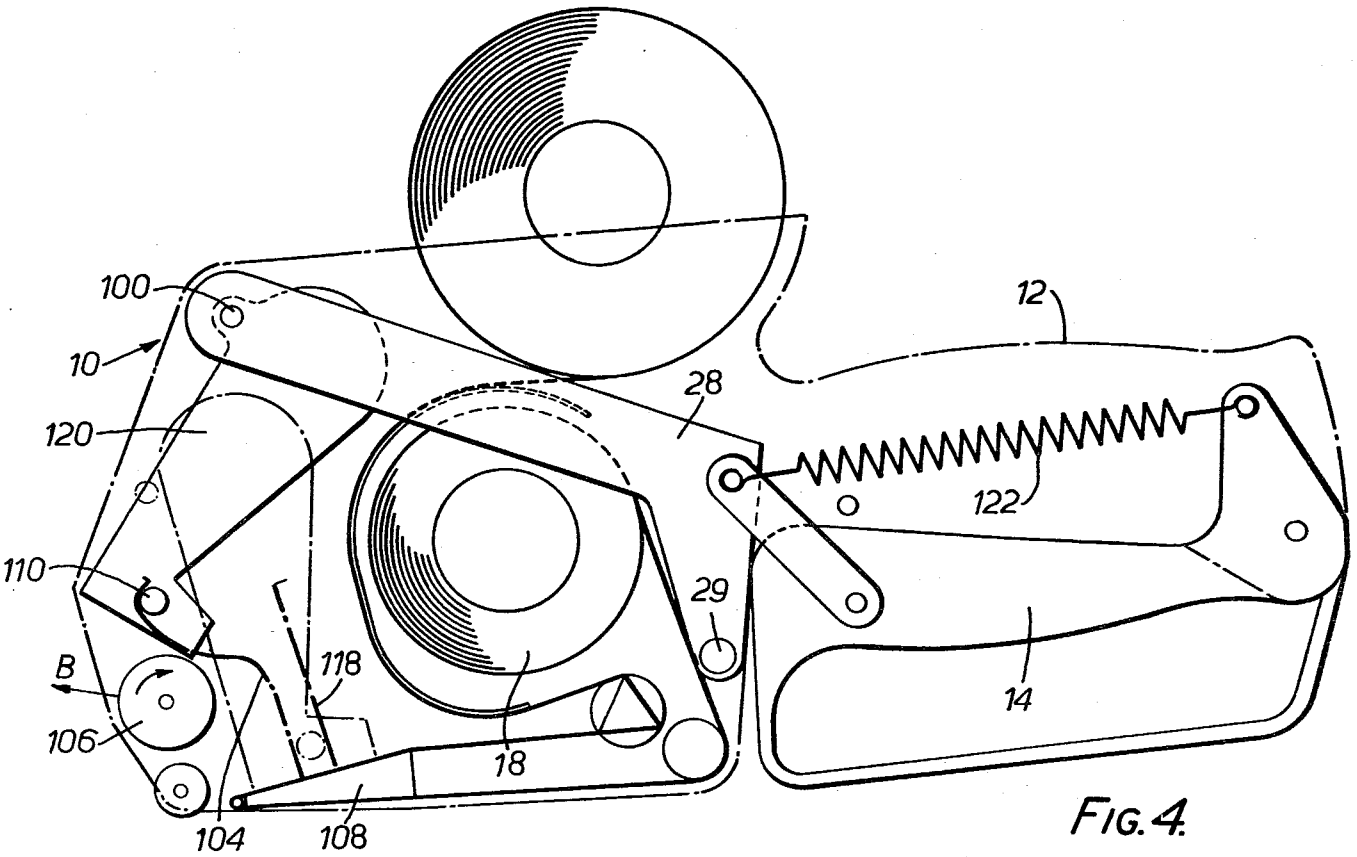
FIG. 4 is a side elevation of a second modification of the print-head assembly of FIGS. 1 and 2.

In the embodiment of FIG. 4 the single print head 120 is arranged to co-operate by means of a spigot with a single cam track 104 as in the embodiment of FIG. 3. The print-head 120 provides only a single line of print but otherwise the construction of the printing mechanism is generally the same as that of the embodiment of FIG. 3 and like parts have been given the same reference numerals. In the operational cycle the retraction of the print-head 120 effected by the spring means 122 causes, as in the first embodiment, the operative print facets to return to their rest position without contacting the inking roller 106. Again as in the embodiment of FIG. 3 the inking roller can be removed either laterally as indicated by the arrow B or axially as in the embodiment illustrated in FIG. 2. The inking roller is preferably mounted for free floating rotation on its spindle and as will be apparent the print head is pivotal both about the pivot 100 and about the pivot 29.

The hereinbefore described embodiments enable the construction of a label applicator with few parts compared with conventional applicators, the number of parts in applicators developed on the basis of the described embodiments being not substantially in excess of the parts shown in the diagrammatic drawings.

The use of a floating, rotary inking roller enables larger tolerances without the resultant penalty of poor print quality often associated with stamp impression applicators and the rotary inking roller ensures that even when the applicator is used at high speed, for example when bench mounted and power-operated, the inking will always be adequate since the same surface of the roller is not presented successively to the operative print facets.

I claim:

1. In apparatus for printing and dispensing labels, at a printing station having a printing surface, a body, a print-head assembly supported within the body, having a row of operative print facets, and being operative to produce a print impression on a label during each operating cycle of the apparatus, said cycle extending in a forward direction from a rest configuration of the apparatus to a printing station configuration and return to the rest configuration, lever means pivotally mounting the print-head assembly in the body, means biasing the lever means to the rest configuration in the operating cycle, means pivotally mounting the print-head assembly on said lever means at a location on the lever means remote from the point of pivoting of the lever means on the body and also remote from the operative print facets, means for actuating the lever means to bring the print-head assembly and the operative print facets thereof to the printing station during each operating cycle, and cam means, including track means controlling the angular orientation of the print head assembly during part of the pivotal motion of the lever means relative to the body and of the print head assembly relative to the lever means, said track means comprising a first track portion that extends from the rest configuration of the print head assembly, and a second track portion that extends from the first track portion towards the configuration at the print station a follower spigot on the print-head assembly disposed at the end of the print head assembly remote from the pivot mounting thereof, an inking roller assembly having an inking roller, said inking roller being operative during the forward portion of the operating cycle to ink the operative print facets and to guide the print-head assembly along its path towards said printing station, the first track portion also being effective, in the absense of the inking roller, to guide the print-head assembly along a path towards the printing station, first said track portion and also the inking roller being ineffective to guide the print-head assembly over the corresponding return portion of the return stroke of the operating cycle under the action of the biasing means so that irrespective of the presence of the inking roller, no further inking of the operative print facets can occur, the second track portion being operative at said printing station in conjunction with the follower spigot positively to constrain the print-head assembly against motion in the plane of the operative print facets thereby to avoid a blurred impression and, the pivot point of the print-head assembly on the lever means being offset substantially from an imaginary plane passing through the operative row of print facets at the printing surface and extending normally to the plane of the row of print facets.

2. Apparatus according to claim 1 wherein the rotary inking roller is rotatably mounted but is fixed in relation to the apparatus as a whole.

3. Apparatus according to claim 1 wherein the print-head assembly comprises two print-heads.

4. Apparatus according to claim 1 wherein the print-head assembly comprises a print-head including two end plates and the inking roller assembly comprises two end flanges, the end plates and the end flanges being so arranged that during the inking part of the operational cycle contact of the end plates and the flanges serves to control the pressure with which the operative print facets contact the roller.

5. In apparatus for printing and dispensing labels, a body, levers pivotally mounted in the body, a print-head mounted for pivotal movement on the levers between a rest position and a printing position, having a row of operative print facets, a spigot adjacent said facets, and the pivot of the print-head on the levers being offset from an imaginary plane extending normally to the plane of the rows of operative print facets, means for actuating the print-head to effect pivotal movement of the levers and of the print-head relative to the levers, track means controlling the angular orientation of the print-head during part of said pivotal movements of the levers relative to the body and of the print-head relative to the levers, and a rotatable, readily detachable, inking roller positioned adjacent to the path of movement of the print-head, said track means comprising said inking roller, a first track portion extending from a rest position of the print-head and lying adjacent the inking roller, and a second track portion extending towards a position at which the operative print facets of the print-head are effective to print a label, said first portion and said inking roller being so located relative to one another that during a first part of the operational cycle of the apparatus, the operative print facets contact the inking roller to receive ink thereupon and to rotate the roller, and said first portion of the track means is ineffective to guide the print-head unless the inking roller has been detached, said second portion serving to guide the operative print facets of the print-head through the spigot thereof to the printing location and from said location during a second part of the operational cycle and to restrain lateral motion of the operative print facets at the said printing position, and said first portion of the track means being ineffective to control motion of the print-head during the second part of the operational cycle by virtue of motion of the print-head under control of the actuating means in a direction away from said first portion of the track means towards the rest position of the print-head.

* * * * *